US005947046A

United States Patent [19]

Yoshida

[11] Patent Number: 5,947,046

[45] Date of Patent: Sep. 7, 1999

[54] SEMISUBMERGED TWIN HULL SHIP

[76] Inventor: Toshio Yoshida, 2-23, Rikyumae-Machi 1-Chome, Suma-Ku, Kobe-Shi, Hyogo-Ken, Japan

[21] Appl. No.: 09/116,650

[22] Filed: Jul. 16, 1998

[30] Foreign Application Priority Data

Dec. 15, 1997 [JP] Japan ..... 9-345124

[51] Int. Cl.[6] ..... B63B 1/00

[52] U.S. Cl. ..... 114/61.1; 114/61.14

[58] Field of Search ..... 114/61.1, 61.12, 114/61.14, 61.2, 61.26

[56] References Cited

U.S. PATENT DOCUMENTS

| | | | |
|---|---|---|---|
| 4,557,211 | 12/1985 | Schmidt | 114/61 |
| 4,763,596 | 8/1988 | Yoshida | 114/256 |
| 4,802,428 | 2/1989 | Lang | 114/61 |
| 4,986,204 | 1/1991 | Yoshida | 114/61 |
| 5,263,427 | 11/1993 | Yamamoto et al. | 114/61.1 |
| 5,265,549 | 11/1993 | Cernier | 114/61.1 |
| 5,529,009 | 6/1996 | Faury et al. | 114/61 |

FOREIGN PATENT DOCUMENTS 2297728 8/1996 United Kingdom .

9325431 12/1993 WIPO .

*Primary Examiner*—Stephen Avila

*Attorney, Agent, or Firm*—Ladas & Parry

[57] ABSTRACT

What prevents high-speed navigation of a large-scale high speed ship in waves is ship oscillation. The concept of the invention has been derived from an idea to control a ship oscillationless longitudinally with small-size fins by providing the ship with struts being formed to have a value of longitudinal metacentric height such that the value of statical restoring moment due to the longitudinal metacentric height ("self-stability moment") does not exceed the value of Munk's instability moment ("Munk moment"). Therefore, a residual Munk moment of negative value as the sum of "Self-stability moment" having a positive value and "Munk moment" having a negative value, is reserved. The ship is characterized by using the controlling effects of the control fin besides designing the strut by taking into account the self-stability moment and the Munk moment. The invention can cause a ship to navigate stably at high speed in waves while easily controlling the longitudinal oscillation by small fins due to the reserving of the residual "Munk moment".

2 Claims, 1 Drawing Sheet

SEMISUBMERGED TWIN HULL SHIP

BACKGROUND OF THE INVENTION

1. Field of the Invention

This invention relates to a semisubmerged twin hull ship which cruises at high speed on wave sea, and in particular to an improvement in its longitudinal ship oscillating motion.

2. Description of the Related Art

Ship's high speed has so far been achieved by either a foil type or a surface effect type for small or medium-size ships, but for large-size ships high speed has so far not yet been realized due to a difficulty in controlling the ship oscillation particularly in the longitudinal direction on wave sea.

It is known that a ship provided with self-stability can hardly control its oscillation, in particular in the longitudinal direction, when the ship cruises in wave sea.

A fin control method of controlling longitudinal ship oscillations has recently been developed. However, no mention has ever been made to using the controlling effects of the fins besides designing the strut by taking into account the self-stability moment and the Munk's instability moment.

This invention aims at controlling ship's longitudinal oscillation by focusing attention on the ship's self-stability moment and the Munk's instability moment for a semisubmerged twin hull ship.

SUMMARY OF THE INVENTION

This invention is characterized in that a semisubmerged twin hull ship makes it possible to navigate in an oscillationless stable status while easily controlling longitudinal oscillation by means of control fins constructed with small areas and in compact sizes, due to a configuration wherein strut means is formed to have a value of longitudinal metacentric height (GML) as to reserve a residual Munk's instability moment, by the fact that the value of a self-stability moment does not exceed the value of a Munk's instability moment.

Where the longitudinal self-stability moment is expressed by $\Delta \cdot GML \cdot \theta$ which works to restore a ship to an upright position when it heels longitudinally, the Munk's instability moment is expressed by $-\rho \cdot \nabla \cdot v^2 \cdot \theta$ which works to heel the ship into a tilting direction when it heels longitudinally during cruising. $\Delta$ is a displacement, $\theta$ is a longitudinal heel angle, $\rho$ is the density of fluid, $\nabla$ is the volume of the submerged hull, v is the ship speed and the residual Munk's instability moment is expressed by $(\Delta \cdot GML \cdot \theta)+(-\rho \cdot \nabla \cdot v^2 \cdot \theta)$.

This solves the problem encountered in the semisubmerged twin hull ship when navigating in wave sea, thus allowing high speed cruising in wave sea, thereby providing an excellent semisubmerged twin hull ship that contributes to the field of the naval architectural technology in marine transportation industry.

The nature and utility of this invention will be more clearly apparent from the following detailed description with respect to preferred embodiments of this invention when read in conjunction with the accompanying drawings.

DESCRIPTION OF THE PREFERRED EMBODIMENTS

Figure 1:
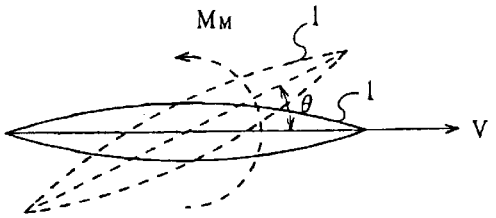
FIG. 1 is a side view of a submerged ship hull, showing how the Munk's instability moment is generated.
Figure 2:
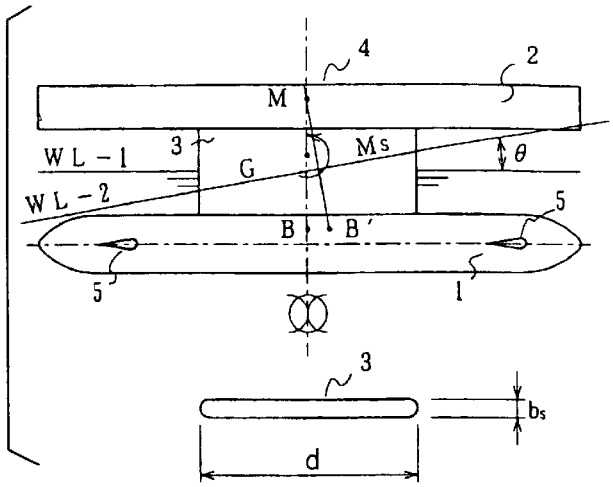
FIG. 2 is a side view of the semisubmerged twin hull ship showing the principle regarding the stability of the ship.

Referring to FIGS. 1 to 4 of the drawings, there is shown a concept of this invention. FIG. 2 is a side view of a semisubmerged twin hull ship. As shown in FIG. 2, the ship is comprised of twin parallel lower hulls 1, an upper hull 2 and struts 3 connecting both the hulls 1 and 2, the struts 3 being afloat on a water line WL-1. The ship is provided with known course changing rudder means, ballasting means and propulsion means, which are not shown in the figure. The lower hulls 1 are provided with at least longitudinal heel controlling fins out of longitudinal and transverse heel controlling fins. In FIG. 2, the longitudinal heel controlling fins 5 are disposed at fore and aft parts of the lower hulls 1.

FIG. 1 shows a status of a submerged lower hull heeled longitudinally at a heel angle $\theta$ while cruising at a speed v. Here is generated a Munk's instability moment $M_M$ (Munk moment) which is a negative restoring moment. The "Munk moment" is expressed by:

$$M_M = -\rho \cdot \nabla \cdot v^2 \cdot \theta \tag{1}$$

where $\rho$ is the density of the fluid, $\nabla$ is the volume of the submerged hull, v is the ship speed and $\theta$ is a longitudinal heel angle.

FIG. 2 shows a principle in which the semisubmerged twin hull ship generates a self-stability moment $M_S$. In FIG. 2, when the ship hull 4 being afloat on still water at zero ship speed heels by an angle $\theta$ longitudinally and causes shifting of the water line from WL-1 to WL-2, the center of buoyancy B is shifted to B'. The point where the line of the buoyancy force working perpendicular to the water line WL-2 through B' intersects the ship hull center line, is the longitudinal metacenter ML. The distance GML between the longitudinal metacenter ML and the ship hull's center of gravity G is called longitudinal metacentric height. When the metacenter ML is at a position higher than G, GML is positive as expressed by GML>0. A longitudinal self-stability moment $M_S$ is expressed by:

$$M_S = \Delta \cdot GML \cdot \theta \tag{2}$$

where, $\Delta$ and $\theta$ are mentioned above.

The longitudinal metacentric height GML is dependent mainly on the strut length d in FIG. 2. The larger the length of the strut, and the larger the longitudinal metacentric height GML, (therefore the larger the self-stability moment $M_S$ of the ship), the larger is the self-stability of the ship.

In this invention, the strut 3 is designed so as to give a value of the longitudinal metacentric height GML such that the value of the self-stability moment $M_S$ does not exceed the value of the "Munk moment" $M_M$, as expressed by $(\Delta \cdot GML \cdot \theta) < (\rho \cdot \nabla \cdot v^2 \cdot \theta)$, and the semisubmerged twin hull ship of this invention provided with said strut can cause the ship to navigate stably at high speed in waves while easily controlling longitudinal oscillation by small-size fins owing to reserving the residual Munk's instability moment expressed with $(\Delta \cdot GML \cdot \theta)+(-\rho \cdot \nabla \cdot v^2 \cdot \theta)$.

Figure 3:
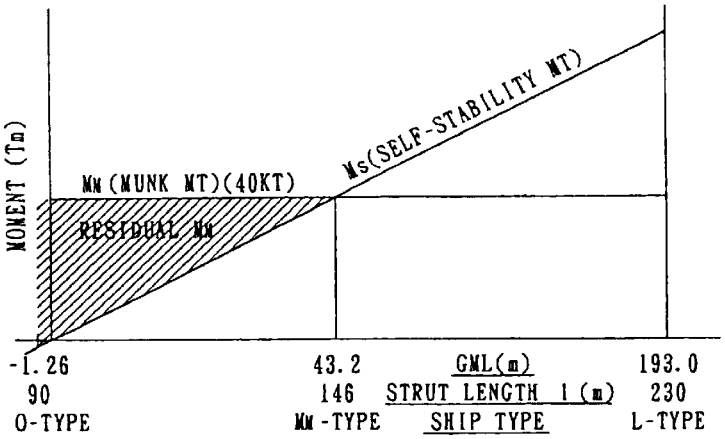
FIG. 3 is a graph showing ship forms reserving a residual Munk moment at a design speed of 40 knots.

FIG. 3 shows a distribution of the residual Munk moment at a speed of 40 knots of three ship types including O-, $M_M$- and L-types with a displacement of 24,000 tons, a length of the lower hulls of 230 m, a diameter of the lower hull of 8.85 m and only the length d of the strut being varied.

1) O-type

O-type has a strut length d of 90 m, a longitudinal metacentric height GML of −1.26 m and a longitudinal self-stability moment $M_S$ of $-30{,}240 \cdot \theta$(Tm) due to GML, calculated from the expression of $M_S = 24{,}000 \cdot GML \cdot \theta$(Tm).

2) $M_M$-type $M_M$-type has a strut length d of 146 m and a value of the longitudinal self-stability moment due to GML being the same as the value of the "Munk moment" $M_M$, during cruising.

3) L-type

L-type has a longitudinal self-stability moment $M_S$ of a sufficient value to self-stabilize the ship and a strut length d of 230 m which is the same as the length of the lower hull L.

The "Munk moment" produced while the ship cruises at 40 knot speed, is calculated by putting the following values into the expression (1).

$$\rho=1{,}025/9.81(T.\sec^2/m^4)\nabla=24{,}000/1{,}025(m^3)$$

$$v=40\text{ knots}=20{,}576(m/\text{sec})$$

$$M_M=-\rho\cdot\nabla\cdot v^2\cdot\theta=-1{,}036{,}000\cdot\theta(Tm)$$

As will be understood from the expression (1), the "Munk moment" remains the same unless the volume of the submerged hull changes.

The longitudinal self-stability moment $M_S$ is calculated by putting the following value into the expression (2).

$$\Delta=24{,}000(T)$$

$$M_S=24{,}000\cdot GML\cdot\theta(Tm)$$

As will be understood from the expression (2), the longitudinal self-stability moment $M_S$ increases as the strut length d increases and the longitudinal metacentric height GML increases.

The O-type with the strut length d of 90 m and with the metacentric height GML of −1.26 m, is a type which generates the residual Munk's instability moment of −1,066,240·θ(Tm) during cruising with 40 knot speed where the longitudinal self-stability moment $M_S$ with a negative value of −30,240·θ(Tm) corresponding to the GML of −1.26 m is added to the "Munk moment" $M_M$ of −1,036,000·θ(Tm) corresponding to the whole "Munk moment" of the ship during cruising at 40 knot speed. The residual Munk moment of −1,066,240·θ(Tm) is equivalent to a modified longitudinal metacentric height of −44.46 m calculated by the following expression: [−1,066,240·θ(Tm)]/24,000·θ(T)=−44.46 m. Therefore, the O-type is self-stabilityless at any forward speed.

The $M_M$-type has a residual Munk moment of the value of zero due to the fact that it has a self-stability moment $M_S$ necessary to have the Munk moment canceled. Thus, the $M_M$-type is a type which has a strut length d of 146 m corresponding to a value of GML of 43.2 m calculated by the following expression:

$$24{,}000\cdot GML\cdot\theta(Tm)=1{,}036{,}000\cdot\theta(Tm)$$

Therefore, the $M_M$-type is self-stabilityless at the design speed of 40 knots.

The L-type is a type with a length of the strut of 230 m which has a self-stability moment large enough to make GML of 193 m, and thus has no residual Munk moment. Therefore, the L-type is never self-stabilityless at any forward speed.

The types of the shaded range in FIG. 3, including the O-type and $M_M$-type, where the residual "Munk moment" exists, is semisubmerged twin hull ships according to the present invention.

Figure 4:
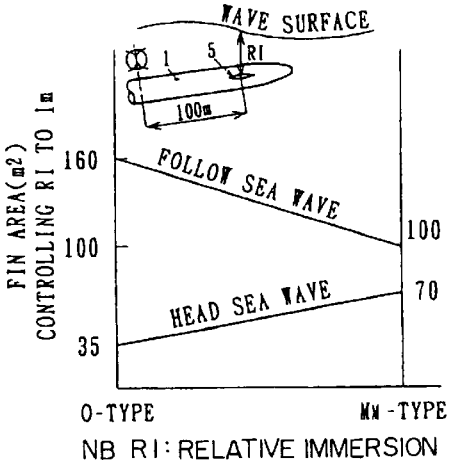
FIG. 4 is a graph showing a ship motion controlling performance in terms of a total control fin area required to keep relative immersion of 1 m which is the value to keep a control fin to 1 m under the water surface.

FIG. 4 explains the effects of the semisubmerged twin hull ship according to this invention. FIG. 4 shows a total control fin area, calculated in the wave of 1/1000 maximum expected value of $M_{1/3}$=6 m significant wave height required to keep the relative immersion of 1 m (RI=1 m), which is a control fin's position under wave surface. The total control fin area is divided into eight fins disposed at fore and aft parts about 100 m apart from the midship of both sides of the twin lower hulls; in FIG. 4, the total control fin area of the O-type is 160 $m^2$ for follow sea wave and 35 $m^2$ for head sea wave, while the $M_M$-type is 100 $m^2$ and 70 $m^2$, respectively. These values show that the O-type is weak to follow sea wave, but strong to head sea wave, while the $M_M$-type has an oscillation performance halfway therebetween.

Both the O-type and $M_M$-type are controlled by fins with such a small area to an extremely small oscillation of RI=1 m.

For the ship form according to this invention where the residual "Munk moment" exists, the propulsive resistance performance varies depending on the size or the speed of the ship, when selecting a ship form design that offers a size matching the ship speed, cruising range, payload, etc. Therefore, selection should be made from various forms including the O-type and the $M_M$-type, by focusing mainly on the superior propulsive resistance performance and on the fact that it is composed of a strut having a length required to maintain the strength for joining the upper hull and the lower hull. And even if the strut having such a required length is designed either in longitudinally integrated type or in split type including two or more longitudinally divided parts on the lower hulls, as long as the ship has strut means forming such a value of longitudinal metacentric height (GML) that the value of self-stability moment does not exceed the "Munk moment" whereby the residual "Munk moment" is reserved, the ship is still included in the scope of this invention.

As described above, the ship of this invention can cause a ship to navigate stably at high speed in wave sea while easily controlling longitudinal oscillation by means of control fins constructed with small areas and in compact sizes due to the fact that the residual "Munk moment" is reserved.

What is claimed is:

1. A semisubmerged twin hull ship comprising:

at least two parallel lower hulls being submerged under the water surface in a cruising status of the ship;

strut means fixed to the lower hulls and extending through the water surface upward therefrom;

an upper hull being above the water surface and fixedly supported on an upper end of said strut means;

rudder means, at least longitudinal heel controlling fin means, water ballasting means and propulsion means;

said strut means being formed to have a value of longitudinal metacentric height (GML) such that the value of longitudinal self-stability moment expressed by Δ·GML·θ does not exceed a value of Munk's instability moment expressed by $\rho\cdot\nabla\cdot v^2\cdot\theta$, where, Δ is the displacement of the ship, GML is the longitudinal metacentric height, θ is a longitudinal heel angle, ρ is a density of fluid on which the ship cruises and v is a ship speed, said self-stability moment being a positive restoring moment generated from the value of GML due to shapes of water plane areas of the strut means, and working to restore the ship to an upright position when the ship heels longitudinally, said Munk's instability moment being a negative restoring moment generated from a shape of ship hull including the lower hulls and the strut means submerged under water surface and working to heel the ship in a tilting direction thereof when the ship heels longitudinally during cruising at a ship speed.

2. The ship according to claim 1, wherein said strut means is formed to have a value of longitudinal metacentric height (GML) such that a residual Munk's instability moment having a negative value expressed by $(\Delta\cdot GML\cdot\theta)+(-\rho\cdot\nabla\cdot v^2\cdot\theta)$ is reserved.

* * * * *